United States Patent [19]

Paccagnella

[11] 4,338,803

[45] Jul. 13, 1982

[54] SKIVING MACHINE FOR HIDES AND SIMILAR MATERIALS

[76] Inventor: Danilo Paccagnella, Via Oltrebrenta No. 6, Noventa Padovana, Padova, Italy

[21] Appl. No.: 173,419

[22] Filed: Jul. 29, 1980

[30] Foreign Application Priority Data

Jul. 31, 1979 [IT] Italy ..... 41605 A/79

[51] Int. Cl.[3] ..... C14B 1/14; A43B 8/34

[52] U.S. Cl. ..... 69/16; 12/58

[58] Field of Search ..... 69/9, 16; 12/16.5, 31.5, 12/46, 46.5, 58, 62

[56] References Cited

U.S. PATENT DOCUMENTS 2,723,551 11/1955 Choice ..... 12/58

3,031,873 5/1962 Brett ..... 69/16

3,091,112 5/1963 Orlando ..... 69/16

*Primary Examiner*—Patrick D. Lawson

*Attorney, Agent, or Firm*—Fleit & Jacobson

[57] ABSTRACT

The machine comprises a dished cutter rotary supported by a shaft connected to a driving shaft by means of a sliding coupling device comprising an extension of the shaft having a radial pin sliding in slots of a hollow shaft.

A grinding wheel is supported by an arm laterally hinged to the cutter and driven by an independent motor to sharpen the cutter with a constant cutting edge. The machine comprises moreover, a clutch controlling the feeding roller for material to be skived, which includes spring means providing thrust, while a speed variator makes it possible to adjust the speed of rotation of the feeding roller.

8 Claims, 5 Drawing Figures

SKIVING MACHINE FOR HIDES AND SIMILAR MATERIALS

BACKGROUND OF THE INVENTION

The invention concern a skiving machine for hides and similar materials, comprising a dished cutter rotary supported by a horizontal shaft, a feeding roller for material close to the cutting edge of the dished cutter and a presser element for the material on the feeding roller, adjustably supported with respect to the roller. The hide, leather or similar material must undergo preliminary skiving around the edges prior to folding, cementing or sewing. The angle and shape of the skiving depend, apart from the thickness of the material, upon other characteristics of the article in leather or similar material, and may vary according to the features of the cutting unit and of the feeding roller on the skiving machine.

DESCRIPTION OF THE PRIOR ART

Known skiving machines are available provided with a grinding wheel for the cutter and a joint for advancing the cutter shaft with respect to a control shaft whenever the cutting edge requires sharpening.

In the known type of machines the grinding wheel is driven by the same motor which controls the rotation of the cutter; with such machines it is difficult to adapt the speed of rotation of the grinding wheel, as it changes in diameter, to the speed of rotation of the cutter, whilst it is practically impossible to maintain the grinding angle of the cutter constant with the continuous wearing of the grinding wheel. Moreover, the use of rubber joints to permit advancement of the cutter shaft has proved to be noisy and subject to break easily.

It is also known that in existing skiving machines, the feeding roller for material is controlled at a practically constant speed, without the possibility of grading the starting-up at the beginning of each cutting operation and to change its speed of rotation according to the skiving to be carried out.

SUMMARY OF THE INVENTION

This invention intends to remedy these drawbacks by providing a skiving machine in which the grinding wheel is controlled by an independent motor and supported by an arm hinged in such a way to permit substantially constant grinding angle of the dished cutter, and in which the cutter shaft is connected to a control shaft by means of a sliding joint which permits a sturdy structure and silent running.

The invention, moreover, is intended for a skiving machine of the type described, in which the feeding roller for material to be skived is controlled by means of a clutch and a speed variator which make it possible to grade and to change the speed of rotation of the roller as required.

An embodiment of the skiving machine according to this invention is described in detail below, with reference to the drawings in which:

DESCRIPTION OF THE PREFERRED EMBODIMENT

Figure 1:
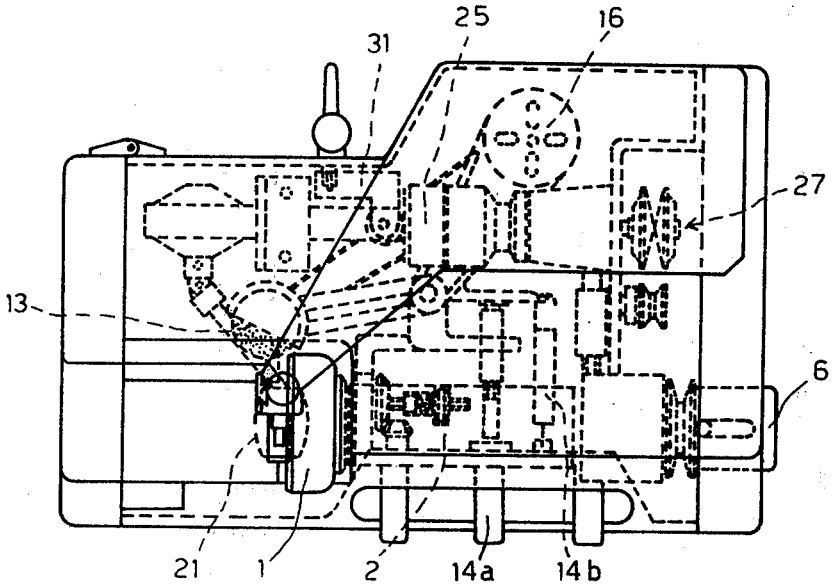
FIG. 1 is a top view of the machine
Figure 2:
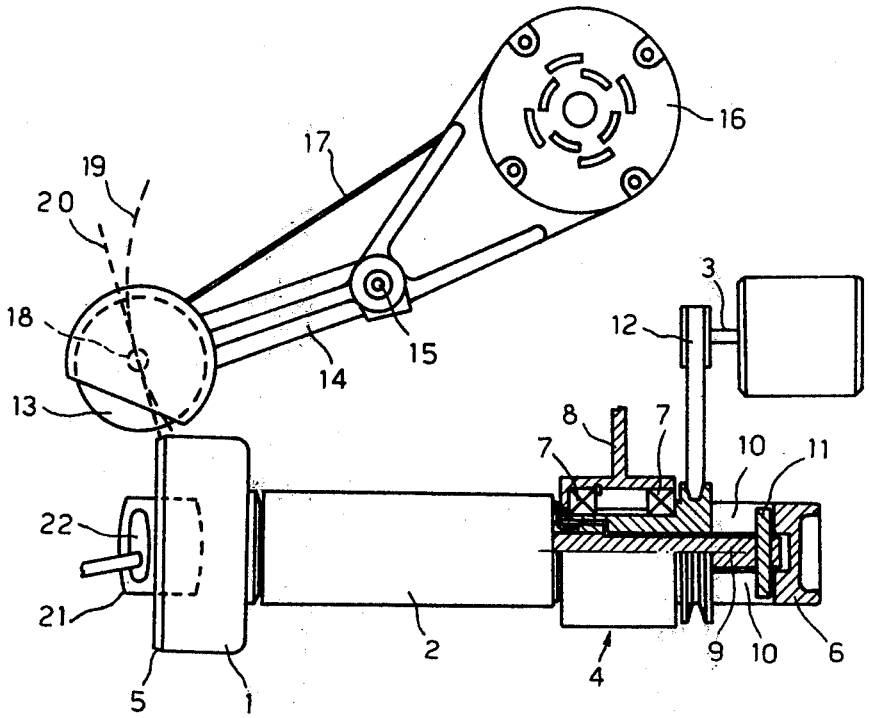
FIG. 2 shows a sectional view of the joint controlling the skiving cutter and the position of the grinding wheel.

With reference to FIGS. 1 and 2, the machine comprises a dished cutter 1, rotary supported by a shaft 2 connected to a driving shaft 3, by means of sliding joint or coupling device 4 capable of permitting axial sliding of the shaft 2, as the cutting edge 5 of the cutter gradually wears.

In particular, the coupling device 4 comprises a hollow shaft 6, supported on bearing 7, by the frame 8 of the machine; one end 9 of the shaft 2 of the cutter slides within the hollow shaft 6. The hollow shaft 6 presents two diametrically opposed lengthwise slots 10, equal in length to the forward stroke of the cutter 1, in which slide the ends of a connecting pin 11 fastened transversally to the rear end of the extension 9 of said shaft. A gearing 12 normally connects the hollow shaft 6 of the joint 4 to the shaft 3 of a driving motor of the machine.

On one side of the cutter 1 is a grinding disk rotary supported by an arm 14, hinged in 15 to the frame of the machine.

The grinding wheel 13 is actuated by an independent motor 16 by means of a gearing 17; said grinding wheel 13 is positioned against the cutting edge 5 of the cutter 1 by operating a handwheel **14*a* which acts against a biasing spring 14*b***.

It can be seen from FIG. 2 that in order to maintain the cutting angle of the cutter 1 practically constant, i.e. the angle formed by the cutting edge of the blade, with the axis of rotation of the blade itself, the grinding wheel 13 is supported in such a way that its axis of rotation 18 moves along an arc of circle 19, tangent to the straight line 20 which forms a right angle with the cutting edge 5 of the blade; by choosing an adequate length of the supporting arm 14 and a suitable position for the hinge 15, it is possible to get the arc of circle 19 along which the axis of the grinding wheel moves, to differ very little from the portion of tangent straight line 20 and practically blend with the said portion.

It is pointed out, merely by way of example, that the bending radius of the arc of circle 19 must be at least two or three times greater than the maximum diameter of the grinding wheel 13, and that the straight line crossing the pivot 15 and the axis 18 of rotation of the grinding wheel forms together with the axis of rotation of the cutter 1, an angle only slightly different to the cutting angle of the blade.

Figure 3:
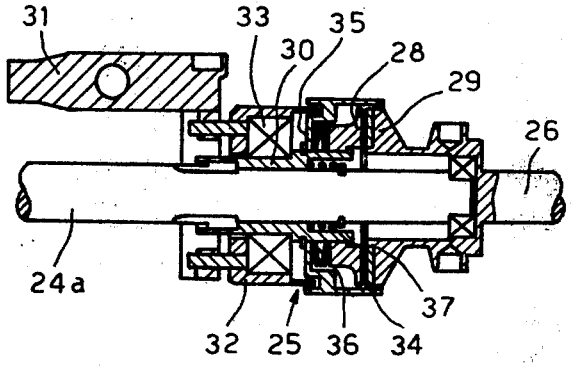
FIG. 3 shows a sectional view of the clutch controlling the feeding roller.

As shown in FIGS. 1, 2 and 3, a feeding roller 21 for material to be skived is situated very close to the cutting edge 5 of the cutter, operating in conjunction with a presser member or feet 22 fixed to an arm 23, to advance the material to be skived.

As shown in said figures, the feeding roller 21 for material to be skived is supported by a cardan shaft 24, connectable, by means of a clutch 25 and a speed variator 27, to the driving shaft 3.

As shown in FIG. 3, the clutch means 25 comprises a first disk 28 connected to the shaft **24*a* controlling the roller 21 and a second disk 29 connected to the shaft 26 of the speed variator 27**.

The first disk 28 is axially movable on the shaft 24*a* by means of a push member 30 operated by a lever 31 hinged to a cup or bell-shaped element 32 supported by means of an axial-thrust bearing 33, by the push member 30.

Said push member comprising moreover a protective cup or bell-shaped element 34 situated coaxially to the element 32 for housing the clutch disks 28 and 29.

Said cup element presents a rear surface 5 spaced apart from the clutch disk 28 so as to form an annular space suitable for a spring means, in the form, for example, of cup-shaped springs 36 or other equivalent means; a spring 37 acts upon the push member 33, in the opposite direction to that of the control lever 31, to keep the disks 28 and 29 of the clutch apart.

The use of a spring means between the push member 33 and the disk 28 of the clutch, is advantageous, as it makes it possible to grade the thrust of disk 28 upon disk 29 at the beginning of each skiving operation, thus avoiding abrupt starting of the feeding roller for the material which could cause faulty or improper skiving, especially around curved edges or on the corners of the piece to be skived.

Figure 4:
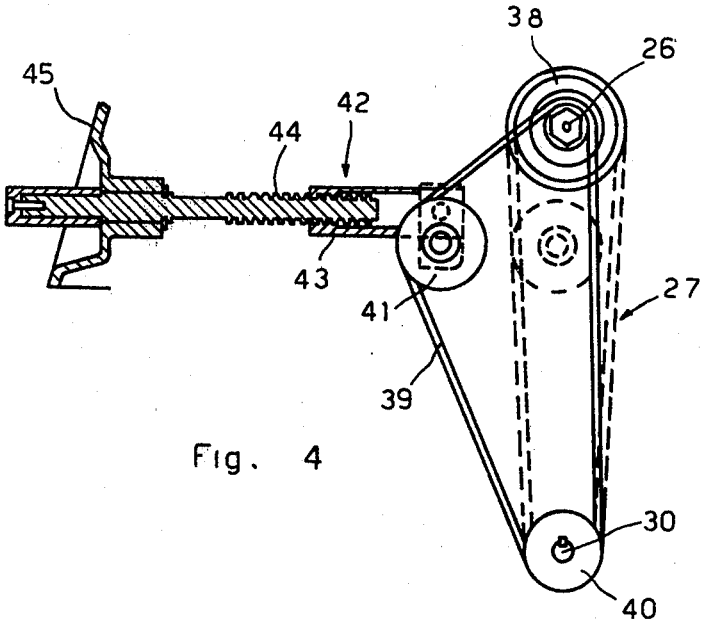
FIG. 4 shows the detail of the speed variator of the feeding roller.

As mentioned previously, it must be possible to adjust the speed of rotation of the feeding roller for material, not only at the beginning of each skiving operation or in particularly difficult parts of the piece of material to be skived, but also to control the speed of rotation of the roller 21 according to the different work requirements, for example, the thickness of the material to be skived or the width and form of the skiving itself. Consequently, a speed variator 27 has been provided between the control shaft 26 of the feeding roller and the driving shaft 3. A possible type of embodiment for the speed variator is shown in the example of FIG. 4. The speed variator 27 comprises an expanding pulley 38, connected to the shaft 26 controlling the roller 21. The pulley 38 can be, for example, as shown in FIG. 1, of the known type comprising two axially mobile disks capable of spreading apart and coming together. A belt 39 or other equivalent means, winds round the pulley 38, round a pulley 40 of the driving shaft 3, and then round a pulley 41 of an idle 42.

The idle 42 can be operated manually to vary the tension of the belt 39, which can thus penetrate, more or less, into expanding pulley 38, consequently varying the diameter of contact with the latter and, therefore, the speed of rotation of the shaft 26 controlling the roller 21.

In particular, the pulley 41 is supported by a lead nut 43 running along a worm screw 44 controlled by means of a knob 45; FIG. 4 shows, merely by way of example, the two extreme positions of the idle pulley 41, corresponding respectively to the minimum and maximum speed of rotation of the roller 21.

Figure 5:
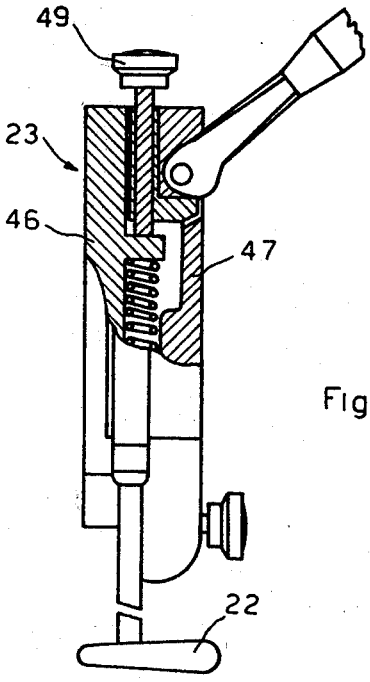
FIG. 5 shows a detail of the supporting arm of the presser feet for the material on the feeding roller.

Lastly, FIGS. 1 and 5 show a further feature of the skiving machine of this invention, relative to the arm 23 supporting the presser member or feet for the material to be skived; as known, proper feeding of the material to be skived depends upon the right amount of pressure on the feeding roller and upon the correct positioning of the pressing feet 22 with respect to the cutting edge 5 of the dished cutter 1; any movement or incorrect positioning of the pressing feet 22 due, for example, to slackness of its supporting means may jeopardize the correct carrying out of a skiving.

In the example in FIG. 5, the positioning device, being part of the arm 23 supporting the pressing feet, comprises an element 46 supporting the pressing feet 22, which is held by a support 47 (FIGS. 1 and 5) fixed to the arm 23 by means of a dovetail joint.

By means of a cam lever it is possible to lower the pressing feet 22 into the working position, at a distance from the roller 12 which is adjustable by means of a screw 49.

What is claimed is:

1. A skiving machine for hides and similar materials comprising a dished cutter rotary supported by a horizontal shaft connected to a driving shaft by means of a coupling device capable of permitting axial movement of the shaft of the cutter, the machine comprising more over a feeding roller for material to be skived, close to the cutting edge of the cutter and a device for grinding the cutting edge of said cutter, in which the device connecting the cutter shaft to the driving shaft comprises a first hollow shaft through which one end of the cutter shaft slides, said hollow shaft having at least one longitudinal slot in which slide a pin radially protuding from the extension of the shaft of the cutter, and in which the device for grinding the cutting edge of the cutter comprises a grinding wheel operated by an independent motor and supported by an arm laterally hinged to the cutter, so that the axis of rotation of the grinding wheel moves along an arc of circle tangent to a straight line substantially at right angles to the cutting edge of the cutter.

2. A skiving machine as claimed in claim 1, in which the axis of rotation of the grinding wheel moves along an arc of circle the radius of which is at least twice the maximum diameter of the grinding wheel itself.

3. A skiving machine is claimed as in claim 1, in which a pressing feet for material to be skived is supported by an arm above the roller in an adjustable way in respect to the feeding roller itself, said pressing feet being supported by an element connected by means of a dovetail joint to a support fastened to the arm of the machine.

4. A skiving machine as claimed in claim 1, in which the feeding roller for material is supported by a shaft connected to a drive shaft by a clutch means comprising a first disk connected to a drive shaft and a second disk connected to the shaft of the feeding roller and a push member acting upon the second disk, in which a spring means is interposed between the second disk and the push member.

5. A skiving machine as claimed in claim 4, in which said spring means is in the form of cup-shaped springs.

6. A skiving machine as claimed in claim 4, in which the clutch disk and the push member are enclosed by cup-shaped protective elements, one of the said cup-shaped elements being rotary supported by the push member whilst the other cup-shaped element being stationery supported by means of bearings.

7. A skiving machine as claimed in claim 4, in which the shaft controlling the feeding roller is connected to the driving shaft by means of a speed variator.

8. A skiving machine as claimed in claim 7, in which the speed variator comprises an expanding pulley connected directly to the controlling shaft of the feeding roller and respectively, to a pulley of the driving shaft by means of a belt drive and in which an idle is foreseen, which can be manually operated to adjust the tensioning of the belt.

* * * * *